United States Patent [19]

Persson

[11] 4,383,671

[45] May 17, 1983

[54] MOULDING TOOL

[75] Inventor: Bengt Persson, Kinne Vedum, Sweden

[73] Assignee: Br. Perssons Cementvarufabrik AB, Sweden

[21] Appl. No.: 280,031

[22] Filed: Jul. 2, 1981

Related U.S. Application Data

[63] Continuation of Ser. No. 124,673, Feb. 26, 1980, abandoned.

[30] Foreign Application Priority Data

Mar. 1, 1979 [SE] Sweden ..... 7901845

[51] Int. Cl.[3] ..... B28B 7/20

[52] U.S. Cl. ..... 249/66 R; 249/2; 425/DIG. 58

[58] Field of Search ..... 249/1, 2, 99, 66 R, 249/66 A, 160, 161, 163, 164, 165, 168, 169, 188, 142, 144, 50; 425/DIG. 58, DIG. 106

[56] References Cited

U.S. PATENT DOCUMENTS

| | | | |
|---|---|---|---|
| 781,514 | 1/1905 | Gray | 249/168 X |
| 799,754 | 9/1905 | Petrie | 249/168 X |
| 904,098 | 11/1908 | Storms | 249/162 |
| 1,294,311 | 2/1919 | Seiferd | 249/169 X |
| 1,520,849 | 12/1924 | Bomback | 425/DIG. 106 |
| 1,983,757 | 12/1934 | Hick | 249/66 A X |
| 2,290,396 | 7/1942 | Webster | 249/66 R |
| 2,327,665 | 8/1943 | Peat | 249/59 |
| 2,336,212 | 12/1943 | Baron et al. | 249/59 X |
| 2,591,607 | 4/1952 | Rich | 249/169 X |
| 3,020,594 | 2/1962 | Makowski | 249/59 X |
| 3,049,758 | 8/1962 | Drevalas | 425/DIG. 58 |
| 3,403,883 | 10/1968 | Simko | 249/66 R X |
| 3,816,048 | 6/1974 | Berry et al. | 249/160 X |
| 3,843,088 | 10/1974 | McLaughlin et al. | 249/59 X |
| 3,848,846 | 11/1974 | Ebner | 249/66 R |
| 4,019,711 | 4/1977 | Altenhof et al. | 249/59 |
| 4,123,495 | 10/1978 | Abey | 425/DIG. 58 |

*Primary Examiner*—J. Howard Flint, Jr.
*Attorney, Agent, or Firm*—Beveridge, De Grandi & Kline

[57] ABSTRACT

A moulding tool for making curb stones from vibrated concrete having a rather high water content, the moulding tool being designed to offer good vibration properties and safe and simple removal of the curb stone from the moulding tool despite the fact that the concrete has a troublesome tendency of adhering to the moulding tool. According to the invention such a moulding tool is characterized in that the mould cavity is defined mainly by a main member of the moulding tool, said main member being a substantially rigid unit, and by two displacable end members, and that the moulded curb stone is removable from the main member in a direction parallel to the direction of displacement of the end members, the end members having means for exerting force on the curb stone when being displaced from the moulding position.

3 Claims, 4 Drawing Figures

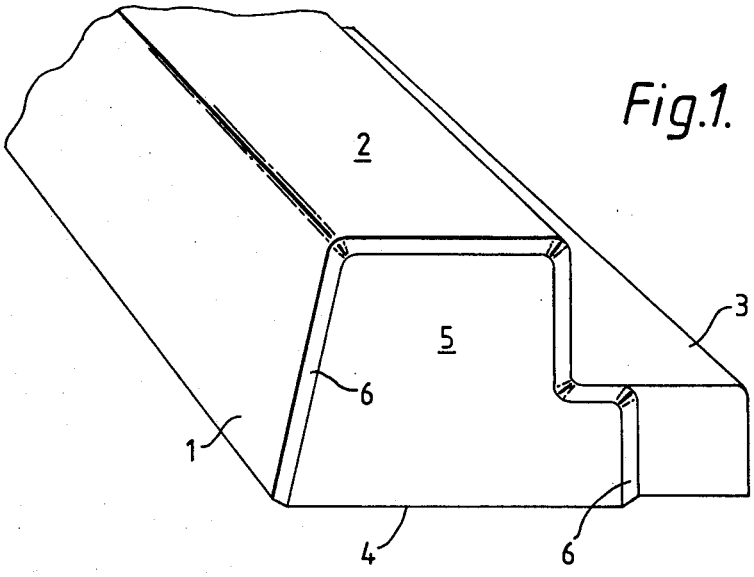
Fig.1.
Fig.2.
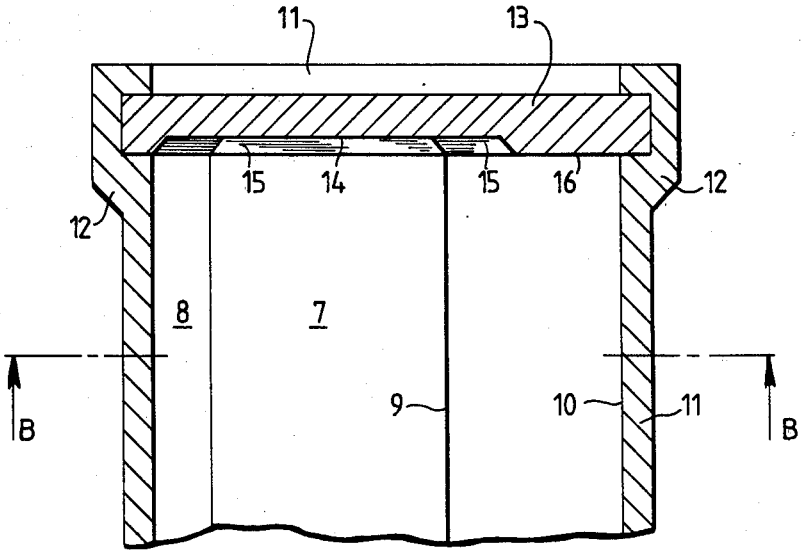

MOULDING TOOL

This is a continuation of application Ser. No. 124,673, filed Feb. 26, 1980, now abandoned.

The present invention relates to a moulding tool designed for producing kerb stones from vibrated concrete and for allowing simple and safe removal of the kerb stones from the moulding tool.

When manufacturing from concrete such articles as pavement slabs or kerb stones, use is usually made of rather dry concrete mixtures, the concrete being pressed under high pressure in moulding tools so that the article is given the intended shape. When removing such a pressed article from the moulding tool, no great problems are encountered, as the pressed concrete has no tendency to adhere to the surfaces defining the mould cavity. Further, the pressing itself, despite use of considerable force does not cause any difficult stress to the moulding tool, as the pressing action could be regarded as substantially static. This means that the design of the moulding tool is not critical and could be easily adapted to the shape of the article to be manufactured. Thus, it is possible to make a moulding tool from several different parts movable relative to each other, the moulding tool being opened along parting lines or hinges when removing the finished article.

When manufacturing as indicated above there are no particular problems keeping close tolerances regarding dimensions or shape. However, the strength properties of concrete produced in this manner are less good. Somewhat exaggerated, the situation could be described thus: the above technique has been developed using as a starting point present machinery and present moulding tools by adapting the proportions of the concrete mixture to these present resources. The result is, as mentioned above, the poor strength properties of the articles manufactured in this way.

For making concrete articles necessarily having high density and good strength properties, the technique described above is not sufficient. Thus, when making concrete articles of this type it is necessary to utilize a concrete composition that is optimized as regards strength properties. This means that the concrete must contain more water than was the case when manufacturing along the lines set forth above. If the strength properties are to be given priority, it is necessary to avoid any porosity of the concrete, i.e. it is necessary to achieve a concrete having a density as high as possible. In practice this is done in a well known way, i.e. by vibrating the concrete before hardening.

Manufacturing of, for example, kerb stones from vibrated concrete on an industrial scale has up to now not been possible with acceptable results as the concrete optimized as regards strength properties has properties making it difficult to use conventional moulding tools and conventional manufacturing techniques. Particularly difficult have been those properties of the concrete resulting in a very good adhering to the surfaces of the moulding tool. This is partially due to the fact that concrete of this quality could be regarded as thixotropic so that, when vibrating the concrete, there is created a thin film of fine slime of concrete and water between the concrete body proper and the walls of the moulding tool.

An obvious way of trying to eliminate the problems due to the adhering of the concrete to the moulding tool would be to have the tool composed of several separate parts so that the tool could be parted at several positions and thus the body of concrete removed after vibrating. However, such a moulding tool comprising several separate parts does not work well with a vibrator, as the tool must constitute a substantially rigid unit if the vibrations are to be transmitted to the concrete. Further, such a tool would be destroyed in a short time under the influence of the vibrations.

Therefore, the present invention has for its object to provide a moulding tool for manufacturing articles from concrete having proportions to give optimized strength properties, the tool being designed in such a way as to avoid the problems mentioned in conjunction with previously known moulding tools.

According to the invention this object is achieved if the moulding tool having a mould cavity is characterized in that the mould cavity, at least partially, is defined by a main member of the tool, said main member being a substantially rigid unit, and by at least one displaceable member of the moulding tool, that the moulded article is removable from the main member in a direction substantially parallel to the direction of displacement of the displaceable member, said displaceable member having means for exerting a force on the moulded article when being displaced from the position in which the moulding takes place.

In an embodiment particularly adapted for manufacturing kerb stones from vibrated concrete there is, according to the invention, foreseen that the moulding tool comprises two displaceable members having shaping portions for shaping the end surfaces of the kerb stone, said shaping portions being located at a distance from the contact surfaces between the main member and the displaceable members in directions out from the mould cavity, and that the force exerting means are constituted by the portions between the contact surfaces and the shaping means and are arranged to produce bevels along the end edges of the kerb stone.

In order to further improve the release of the moulded article there is, according to the invention, preferably foreseen that the displaceable members are provided with notches at their rear edges as seen in the direction of displacement for letting air into the mould cavity when removing the moulded kerb stone.

The invention now is described more in detail, reference being made to the accompanying drawings. On these FIG. 1 shows in perspective an end portion of a kerb stone made in the moulding tool of the invention.

FIG. 2 shows a cross sectional view along line A—A in FIG. 3.

Figure 3:
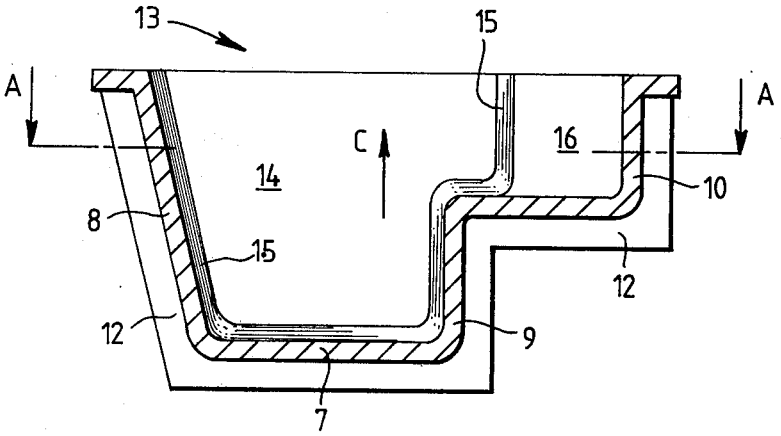
FIG. 3 shows a cross sectional view of the moulding tool according to the invention, the section being taken substantially along line B—B in FIG. 2.

In FIG. 1 there is shown in perspective an end portion of a kerb stone made in a moulding tool according to the invention. From this figure it is apparent that the kerb stone has a front surface 1 facing the driveway, an upper surface 2 and on the side remote from the driveway a projection 3, usually embedded in the surface material proper of the pavement. The lower surface 4 of the kerb stone is quite plain and is facing upwardly during the manufacturing process. From the figure it is also evident that the end surface of the kerb stone gives the kerb stone a pleasant appearance and partly facilitates the removal of the kerb stone from the moulding tool. Further, it is evident that the central portion does not extend to the back edge of the extension 3 so that, at adjacent kerb stones, there are provided openings between the extensions 3. The purpose of these openings is to allow the kerb stones to be laid along a curved line without having too wide a slot between the front edges of the kerb stones.

FIG. 2 shows a cross sectional view of an end portion of a moulding tool for making the kerb stone of FIG. 1. The moulding tool is seen from above in position for moulding. From the figure it is evident that the tool has a bottom surface 7, one sloping side surface 8, one lower side surface 9 and an upper side surface 10. The sloping side surface 8 has the purpose of shaping the front surface 1 of the kerb stone while the upper side surface 10 is adapted for shaping the back, vertical side surface of the extension 3. The surfaces 7–10 of the tool are arranged to constitute a rigid unit and could be made by a moulding process or by a milling process so that the rigid unit or the main member 11 of the tool preferably is integrally made from metal. At both ends of the rigid unit or the main member 11 of the tool there are provided thickened wall portions 12 having inwardly facing grooves for displaceably receiving end pieces 13 of the moulding tool. The end pieces 13 are displaceable perpendicularly with respect to the plane of the drawing, i.e. in the same direction as the finished kerb stone is removed from the main member 11.

From FIG. 2 is clear that the central portion 5 of the end surface of the kerb stone is shaped by the recessed portion 14 of the end piece 13, said recessed portion having at its periphery a bevelled junction 15 joining the remaining plane inner surface 16 of the end piece. When comparing FIGS. 1 and 2 it should be apparent that the junction 15 has the purpose of shaping the bevelled edge portion 6 of the kerb stone. However, the junction also has another and a very important purpose, as will be described more in detail below.

FIG. 3 shows a cross sectional view on line B—B in FIG. 2. Thus there is seen that the upper side surface 10 and lower side surface; 9 of the main member 11 are parallel to each other and perpendicular to the upper edge of the moulding tool. The displaceability of the end pieces 13 mentioned above can be achieved from the position of FIG. 3 in the direction of arrow C to a position shown in FIG. 4. The edge portions of the end pieces 13 are received and guided in grooves provided on the inner side of the thickened end portions 12 of the main member 11 of the moulding tool, as seen in FIG. 2. Thus, any motion other than that indicated at arrow C is impossible.

Figure 4:
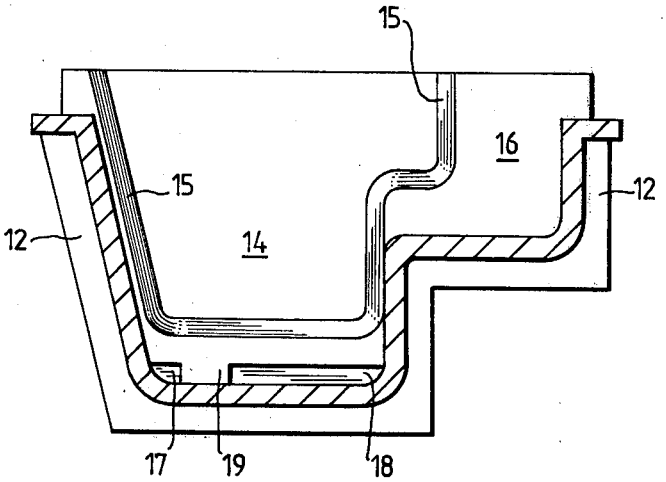
FIG. 4 shows a cross sectional view corresponding to FIG. 3, the displaceable member of the tool being displaced to its opened position for removing the finished article from the tool.

In FIG. 4 the end piece 13 is shown displaced in the direction of arrow C to its upper end position. It is clearly seen that the end pieces in their lower edges (rear in the direction of displacement) adjacent the bottom surface 7 of the main portion 11 are provided with notches 17 and 18 located at each side of a guide projection 19. The purpose of these notches is to make it possible to let air into the space between the upper surface 2 of the kerb stone and the bottom surface 7 of the moulding tool when removing the kerb stone from the moulding tool.

The present moulding tool is used in the following manner: During the moulding process the moulding tool is arranged with the bottom surface 7 facing downwardly and is possibly partially on its upper side provided with a lid preferably having a filler funnel or a filler chute for concrete. Further, the end pieces 13 are located in the positions of FIG. 3 during moulding. The moulding process is commenced by filling a predetermined volume of concrete into the mould cavity via the filler chute. Then the moulding tool is exposed to vibrations generated by a suitable vibrator preferably connected to the main member 11 of the moulding tool. After vibrating, the lid with the filler chute is removed and the moulding tool is turned upside down relative to the position shown in FIGS. 3 and 4. In doing so the moulding tool is held in such a position that there is a space of approx. 1 cm between the lower side 4 of the kerb stone and a supporting surface. In this position the kerb stone is caught in the moulding tool due to the big adhering forces mentioned above and due to the fact that no air can be admitted into the moulding tool, especially not into the space between the upper surface 2 of the kerb stone and the bottom surface 7 of the moulding tool. To facilitate removing the kerb stone from the moulding tool the end pieces 13 are displaced to the positions of FIG. 4 (note, the moulding tool has an inverted position as compared with the position of FIG. 4). As the kerb stone on its end surfaces is provided with the central portion 5 extending outwardly of the parting line between the main member 11 and the end pieces 13 of the moulding tool the beveled junctions 15 on the end pieces impart a downward movement to at least the end portions of the kerb stone. This means that the kerb stone is curved somewhat when this movement is initiated as the mid portion thereof is adhering to the internal surfaces of the moulding tool. However, directly after initiating the downward movement of the end pieces, the notches 17 and 18 are exposed so that air is admitted into the moulding tool. As soon as enough air has been admitted, the kerb stone will fall under influence of gravity down onto the support surface, a proper sliding action taking place between the end surfaces of the kerb stone and the end pieces of the moulding tool, between the back surface of the extension 3 and the upper side surface 10 of the moulding tool and between the lower side surface 9 of the moulding tool and the corresponding surface of the kerb stone. When the kerb stone is supported completely by the support surface the moulding tool is lifted vertically upwards. Then the end pieces of the tool are displaced back to their moulding positions and the moulding tool is turned so that a new cycle of operation could be started.

The invention could be modified within the scope of the following claims. Thus, it is possible to design the end surfaces of the kerb stone in a way different from that shown in FIG. 1. For example it is possible to have the bevel 6 extend along all edges of the end surface. This means, however, that the possibility of laying the kerb stones along a curved line is lost. Further, it is also possible, according to the invention, to have the bevel 6 extend along all edges except along the upper surface 2 of the kerb stone and possibly along the upper side of the extension 3.

Further, it is possible to give the end surfaces of the kerb stone, and particularly the central portion thereof, a shape different from that plain one as shown. Especially, reference is being made to the possibility of arranging on the central portion depressions and corresponding projections engaging each other on adjacent kerb stones so that the adjacent kerb stones are locked relative to each other. Such projections and depressions on the central portions 5 are achieved by providing corresponding depressions and projections respectively on the end pieces 13, the projection necessarily being arranged as a separate part possible to be withdrawn from the mould cavity before the end pieces are displaced.

What is claimed is:

1. A moulding tool for moulding an elongated article from concrete in a mould cavity and allowing the article to be removed from said mould cavity before hardening of the concrete, said tool comprising a unitary, substantially rigid main body member having therein an elongated, open-ended recess forming a three-sided, elongated cavity, with a groove in the three sides of said cavity adjacent each open end of said recess; and a pair of end members, each end member received in one of said grooves to close the adjacent end of said recess to define an open-sided mould cavity for moulding an elongated article, said end members being slidably displaceable in said grooves; each end member having at least one notch passing therethrough at the edge thereof, adjacent the bottom of said main body member, and in a position to be covered by said main body member when said end member is fully received in the respective groove and to be exposed as said end member is slidably displaced in said groove so that as said end members are slidably displaced with slight initial bending of the adjacent end portions of the article, air is admitted between the article and said body member to release the article from said mould cavity, with the article being removable out the open side of said mould cavity by movement in a direction parallel to the direction of displacement of said end members.

2. A moulding tool as claimed in claim 1 in which each end member includes a shaping portion for shaping the end surface of the article, said shaping portions located a distance from the junctions of the end members and the body member.

3. A moulding tool as claimed in claim 1 in which said body member and said end members are shaped to form bevels along the end edges of the article.

* * * * *